US006516571B1

(12) United States Patent
Overthun et al.

(10) Patent No.: US 6,516,571 B1
(45) Date of Patent: Feb. 11, 2003

(54) FREESTANDING SCREEN SYSTEM

(75) Inventors: Thomas Overthun, San Francisco, CA (US); George J. Simons, Jr., Grand Rapids, MI (US); Thomas B. Eich, Palo Alto, CA (US); James N. Ludwig, Grand Rapids, MI (US); David M. Gresham, Grand Rapids, MI (US)

(73) Assignee: Steelcase Development Corporation, Caledonia, MI (US)

( * ) Notice: Subject to any disclaimer, the term of this patent is extended or adjusted under 35 U.S.C. 154(b) by 0 days.

(21) Appl. No.: 09/723,996

(22) Filed: Nov. 28, 2000

(51) Int. Cl.[7] ..... A47G 5/00

(52) U.S. Cl. ..... 52/36.1; 52/481.2; 52/245; 52/243; 52/273; 160/351; 160/352

(58) Field of Search ..... 52/282.2, 36.1, 52/239, 481.2, 245, 283, 243, 222, 273; 160/135, 351, 352; D6/332

(56) References Cited

U.S. PATENT DOCUMENTS

| | | | | | |
|---|---|---|---|---|---|
| 1,706,388 | A | | 3/1929 | Ashkenas | |
| 2,210,652 | A | | 8/1940 | Dennett | |
| 3,017,969 | A | * | 1/1962 | Nielsen | 52/239 |
| 3,592,289 | A | | 7/1971 | Aysta et al. | |
| 3,875,711 | A | * | 4/1975 | Palmer | 52/239 |
| 4,068,700 | A | | 1/1978 | Legler | |
| 4,121,645 | A | | 10/1978 | Behr | |
| 4,516,620 | A | | 5/1985 | Mulhern | |
| 4,966,181 | A | | 10/1990 | Liberman et al. | |
| 4,969,500 | A | | 11/1990 | Makosa | |
| 5,065,558 | A | * | 11/1991 | Boatsman | 52/239 |
| 5,213,312 | A | * | 5/1993 | MacDonald | 256/26 |
| 5,272,848 | A | | 12/1993 | Maas | |
| 5,486,391 | A | | 1/1996 | Tyner | |
| 5,689,926 | A | | 11/1997 | Nichols | |
| 5,875,597 | A | | 3/1999 | Gingrich et al. | |
| 5,966,857 | A | * | 10/1999 | Pettersson et al. | 40/606 |
| D415,901 | S | | 11/1999 | Arko et al. | |
| 6,116,326 | A | * | 9/2000 | Domina et al. | 160/351 |

* cited by examiner

*Primary Examiner*—Carl D. Friedman
*Assistant Examiner*—Jennifer I. Thissell
(74) *Attorney, Agent, or Firm*—Price, Heneveld, Cooper, DeWitt & Litton

(57) ABSTRACT

A screen apparatus includes a perimeter frame with a notch and arcuate foot in one of the bottom corners that are adapted to receive a raised floor device, such as a raised power outlet. A covering covers the frame but the notch is not covered. The covering is preferably a light-passing translucent sheet of performance fabric which is adapted to pass light sufficient for a viewer to see a person behind the screen, but which scatters and blocks sufficient light to provide privacy by hiding details of the person's work from the viewer. The screen apparatus also includes bowed frame members extending horizontally between some of the outer frame members. The perimeter frame and bowed frame members space the front and rear panels of the covering from each other in a three-dimensionally curved manner, which results in additional visual hiding power to the screen apparatus and further results in a novel appearance of sweeping arcuate visual lines based on the non-planar partial-see-through condition of the two-panel covering. A hub is provided for selectively interconnecting screens in a radial arrangement.

18 Claims, 4 Drawing Sheets

FREESTANDING SCREEN SYSTEM

BACKGROUND OF PRESENT INVENTION

The present invention concerns screens for dividing areas, such as for separating office areas in a building space.

Workers are often positioned relatively close together in modern offices, since office space is expensive. However, as a worker's space is reduced, the need for personal and professional privacy becomes more apparent and important. For example, the worker may need (or desire) privacy of their work papers or of their conversations with others. Further, the need for privacy may vary during the day, depending on various activities and discussions that the worker may be engaged in. These requirements are conflicting and not easily solved or balanced.

Privacy can be facilitated by using portable screens, which can be moved about and arranged as required. However, such screens must be low cost, light in weight, and effective visual shields, yet durable, highly aesthetic, and easy to move. Also, the screens should preferably be storable in a dense arrangement to minimize the space required for storage. Also, it is desirable for the screens to be designed to facilitate washing and cleaning.

Another problem with screens is that they must be able to provide privacy over and around raised floor devices, such as utility outlets and connections. Specifically, modern offices require multiple power and communication connections, which often are positioned in or on floors. As office layouts change, these connections often end up at locations where a screen needs to be placed. It is desirable to provide a screen that is adapted to work in and around such connections, without the screen unacceptably engaging the raised floor device. In particular, utility outlet devices are often located at the edge of offices where multiple offices can access the utility outlet devices. Utility-using devices, such as telephones, computers, display terminals, keyboards, and the like, are plugged into the utility outlet devices, resulting in wires and power plugs extending above and along the floor, especially in the area of the utility outlet device. This can prevent a screen from being placed to optimally divide two (or more) offices, since the screen cannot be positioned to separate the offices at a location directly above the utility outlet device since this would place a foot of the screen on top of the utility outlet device.

Yet another problem is that workers need to be able to maintain their privacy, yet they need to be able to see if a worker is at his or her office to talk. Some screens are made sufficiently low in height to permit a worker to see over the screen. However, this results in all privacy being lost whenever a curious worker wants to see into another worker's office. It is desirable to provide partial visual access into an office to permit a worker to see if the other worker is there, while still preventing the first worker from secretly peering over screens to see working documents.

Accordingly, an apparatus solving the aforementioned problems and having the aforementioned advantages is desired.

SUMMARY OF INVENTION

In one aspect of the present invention, a screen apparatus includes a perimeter frame defining opposing bottom corners. One of the bottom corners defines a notch adapted to receive a raised floor device, such as a raised power outlet, while a portion of the perimeter frame is positioned over the floor device. A covering is provided that covers the frame but that leaves the notch open.

In another aspect of the present invention, a screen apparatus includes a perimeter frame having outer frame members forming a perimeter and having at least one bowed frame member extending between some of the outer frame members. A screen covers the frame and includes at least one flexible panel engaging the bowed frame member to cause a non-planar condition in the flexible panel.

In yet another aspect of the present invention, a screen system includes a plurality of screens each having a frame, and first and second post supports extending below the frame. A hub is provided that has a bottom section adapted to stably engage a floor surface. The hub also has a top section with multiple connectors. The multiple connectors are each shaped to selectively releasably engage the first post supports to secure the plurality of screens in radial positions around the hub connector.

In still another aspect of the present invention, a screen system includes a plurality of identical screens each having a covered frame defining a vertical longitudinal plane and first and second supports extending below the frame for stably engaging a floor surface. One of the first and second supports includes a post spaced from a vertical side edge of the covered frame and further includes a foot extending laterally from the post. The foot includes front and rear portions that extend around a space under the vertical side edge and that extend to a transverse plane that intersects the vertical plane at the vertical side edge. The foot of each screen is configured and adapted to nest against a raised floor device with the vertical side edge being positioned directly over the raised floor device. The foot of each screen is also configured to nest into the foot of an adjacent one of the identical screens in a nested storage position where each successive adjacent screen is positioned adjacent and parallel but longitudinally offset from the adjacent screen.

These and other features, advantages, and objects of the present invention will be further understood and appreciated by those skilled in the art by reference to the following specification, claims, and appended drawings.

DESCRIPTION OF THE PRESENT INVENTION

Figure 1:
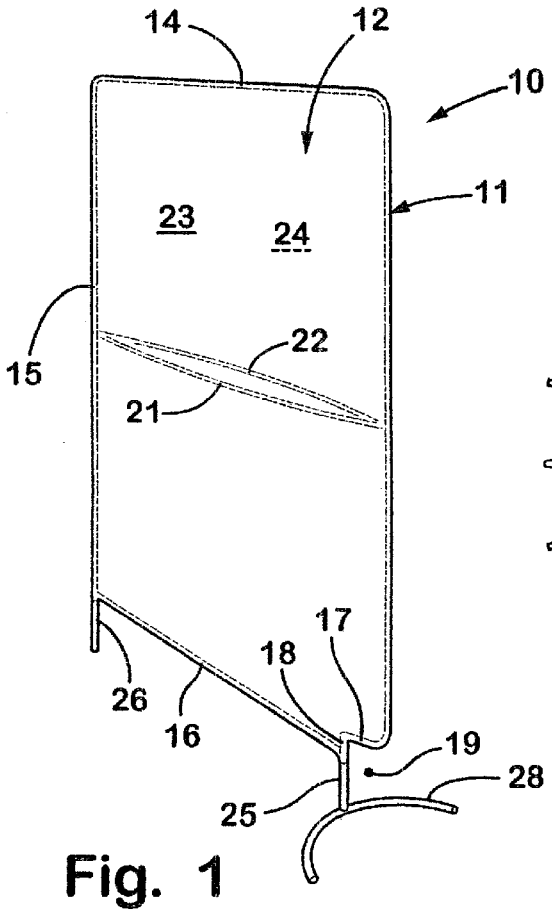
FIGS. 1–4 are perspective, end, front and top views of a screen embodying the present invention.
Figure 4:
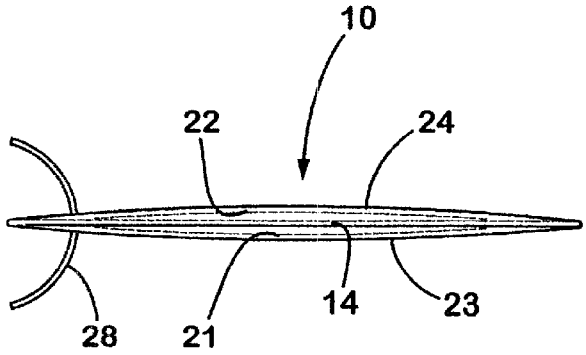
Figure 2:
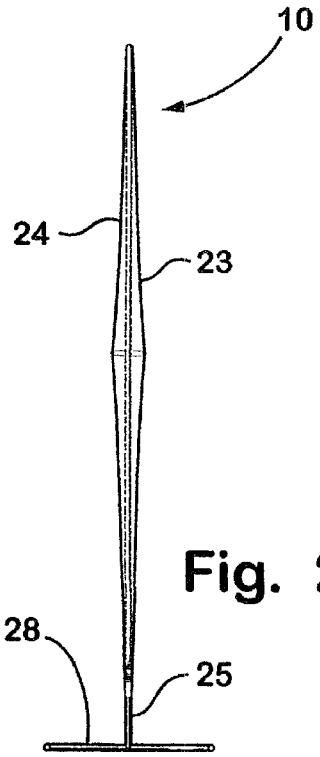
Figure 3:
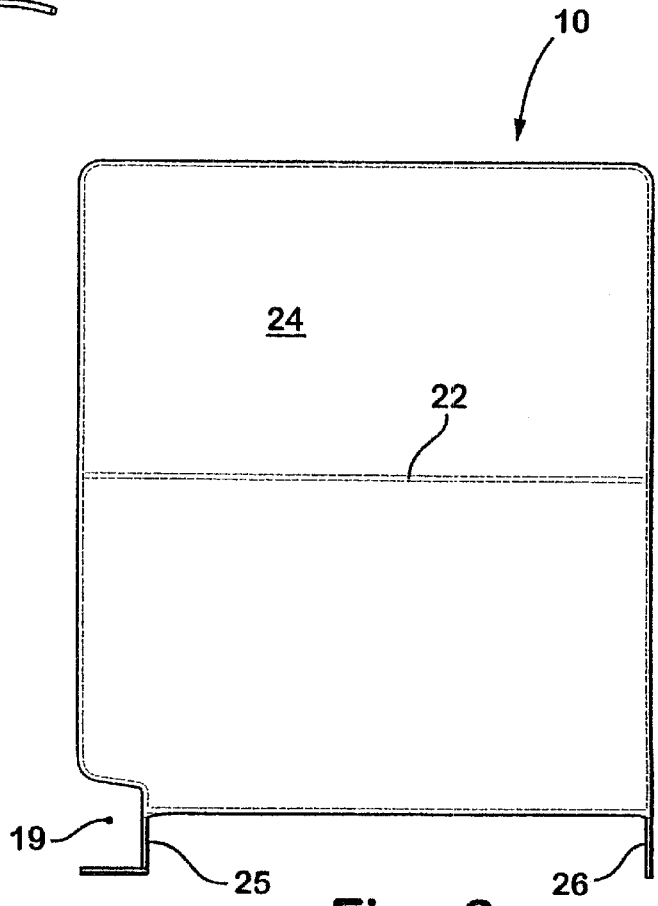

A screen apparatus 10 (FIG. 1) includes a frame 11 and a flexible covering, such as the illustrated performance fabric sheet 12, wrapped around and covering both sides of the frame 11. The frame 11 includes perimeter frame members 13–16 defining a rectangle with rounded upper corners. One side frame member 13 includes lower sections 17 and 18 forming an offset lower end that defines a notch 19. Advantageously, the notch 19 permits the screen 10 to matably receive a raised floor device, such as a raised power and communication outlet module 20. (See FIG. 7A.) The side frames 13 and 15 include post-like end sections 25 and 26 that extend below the bottom frame member 16. A foot 28 is attached to the post section 25 and extends around the notch 19 to a location equal to an edge of the screen in side view (see FIG. 3). More specifically, the ends of the foot 28 terminate at a vertical plane that extends through side frame member 13 and that extends perpendicular to the frame members 14 and 16. The foot 28 stabilizes the screen 10 and makes it freestanding and self-supporting, but the foot 28 advantageously does not interfere with positioning an end of the screen against the floorsupported utility module 20 with the end of the screen located over the module 20. (For example, see FIG. 7A).

The frame 11 (FIG. 1) further includes a pair of arcuately-shaped bowed intermediate frame members 21 and 22 that extend horizontally across the frame 11. The bowed frame members 21 and 22 hold apart front and rear panels 23 and 24 of the sheet 12, and create a three-dimensional effect on the sheet that is modernistic and attractive. When image-passing semi-translucent performance fabric is used for the sheet 12, the combination provides an aesthetic appearance of curvilinear lines across the fabric that follow the curvature of the panels 23 and 24, as described below.

Figure 8:
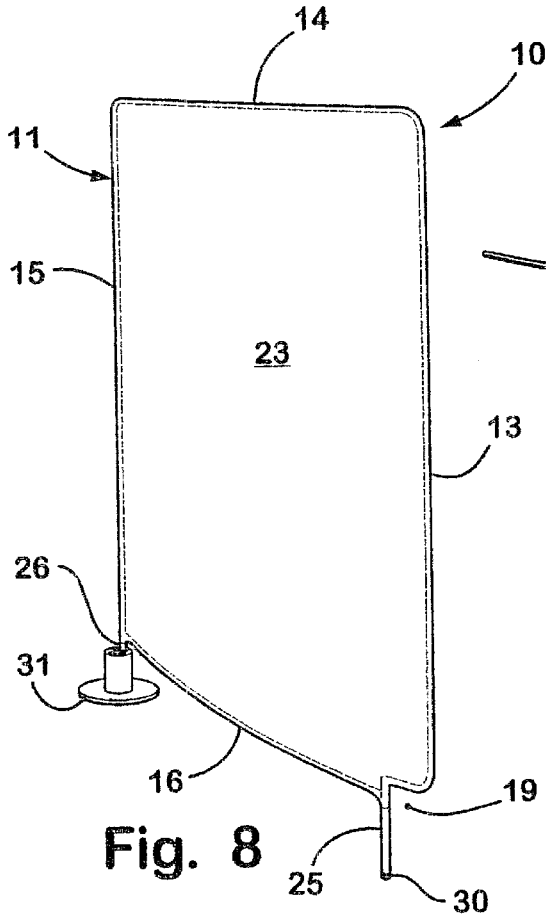
FIGS. 8–11 are perspective, end, front and top views of a screen similar to the screen of FIG. 1 with modified feet.
Figure 11:
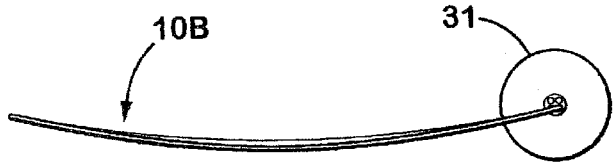

The frame 11 is made from lightweight tube segments or stiff rod, such as aluminum, steel, plastic or other stiff material. It is contemplated that the segments can be made from a single bent component, or a plurality of bent and/or welded sections. As illustrated, the top and side frame members 13–15 are bent into an inverted U-shape from a single rod, and bottom frame member 16 is welded across a bottom of the U-shape several inches above the floor. The foot 28 is a semi-circularly shaped section of bent rod and is welded to the post section 25 that extends below the bottom frame member 16. The area inside the arc of the foot 28 lies below the notch 19, and forms an enlarged pocket for receiving the floor-mounted utility module 20. The illustrated post section 26 is non-adjustable, but it is noted that it can be made adjustable, such as by providing a threaded hole for receiving a bolt longitudinally upwardly into the post section 26 (see FIG. 8).

The sheet 12 wraps around the frame and covers both sides of the frame 11, such that the sheet 12 helps stabilize and hold the frame 11 in its rectangular shape. The bowed frame members 21 and 22 further stabilize the frame 11, especially in its vertical side edges where the bowed frame members 21 and 22 are connected. This allows the sheet 12 to be tensioned and stretched to eliminate all wrinkles. The sheet 12 can be permanently sewn onto the frame 11, or it can include a zipper, snaps, or other means to facilitate its removal from the frame 11 for cleaning.

The sheet 12 is made of a material that permits some visual access through the sheet due to the fabric fibers/threads being spaced slightly apart, but the fibers/threads are sufficiently dense to prevent visual access to details. For example, it is not possible to read printed material through the sheet 12, particularly through the two spaced-apart panels 23 and 24 of the sheet 12, but it is possible to see and potentially recognize a person seated on a side of the screen 10 opposite the viewer. The illustrated sheet 12 is made from a performance fabric, which is stretchable to about 20% or more. The sheet 12 has a see-through visibility factor of about 10–50%, depending on the brightness and direction of light. Due to the two panels 23 and 24 being spaced apart and stretched to a non-planar condition by the bowed frame members 21 and 22, the visual image that is seen through the screen is disrupted by curvilinear waves of lines. This is believed to be caused in part when the gaps in fibers/threads in the first panel 23 are covered by fibers/thread in the second panel 24. The result is that, although a viewer can see a seated person through the screen 10, the image of the seated person is partially blocked by swirling curvilinear patterns of blocked out areas. The swirling patterns change as a person walks past the screen, creating a dynamic artistic effect. This swirling pattern creates an image that is particularly attractive, but also increases the effectiveness of the screen by reducing the detail that can be seen through the screen 10, even though a light-passing translucent fabric is used that potentially allows viewers to see objects through the fabric.

Figure 5:
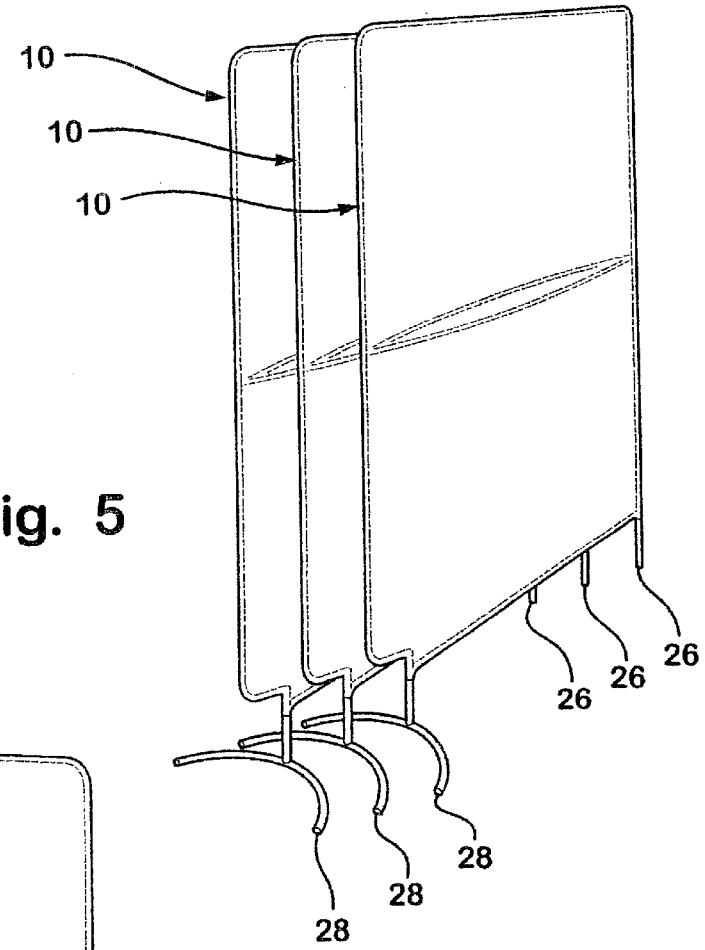
FIGS. 5–6 are perspective views showing a plurality of the screen of FIG. 1, the screens in FIG. 5 being positioned adjacently in a stored position and the screens in FIG. 6 being positioned in-line in a use position.

FIG. 5 discloses three screens 10 positioned adjacently parallel in a dense storage position. Specifically, each foot 28 is positioned inside of the crescent-shaped foot 28 of an adjacent screen 10. Notably, the screens 10 are spaced apart due to the bowed intermediate frame members 21 and 22. The result is that each successive screen 10 is offset several inches in a direction perpendicular to a face of the adjacent screen and also offset longitudinally several inches in a direction parallel the face of the adjacent screen.

Figure 6:
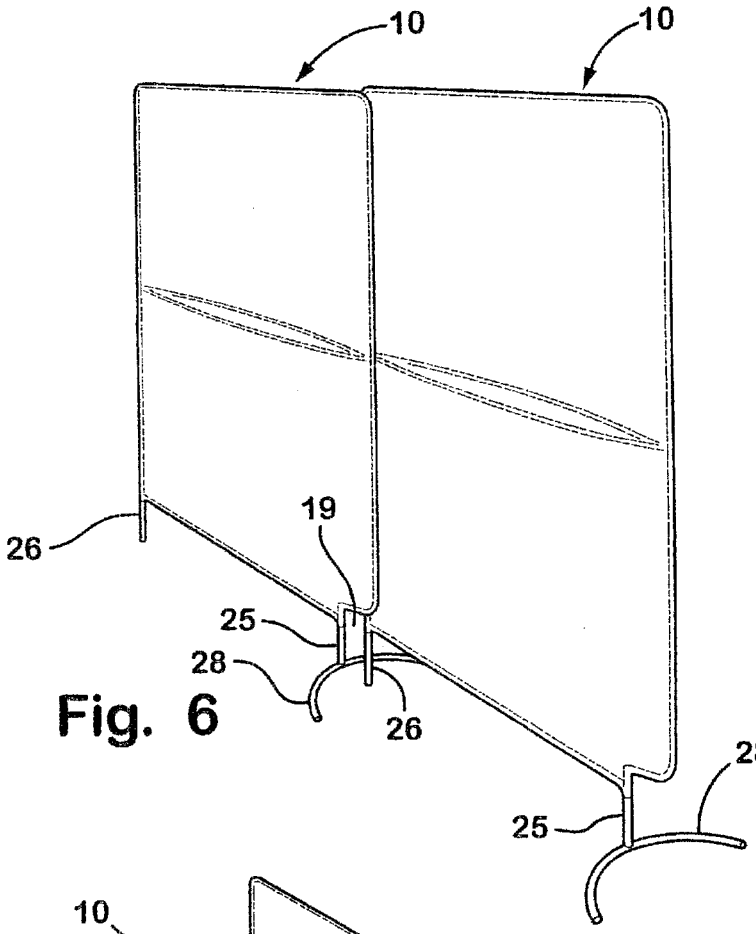

FIG. 6 discloses two screens 10 positioned in-line with each other, with the adjacent ends slightly overlapping each other. The overlap is facilitated by the post section 26 of one screen 10 being positioned inside the crescent-shaped foot 28 of the adjacent screen 10.

Figure 7:
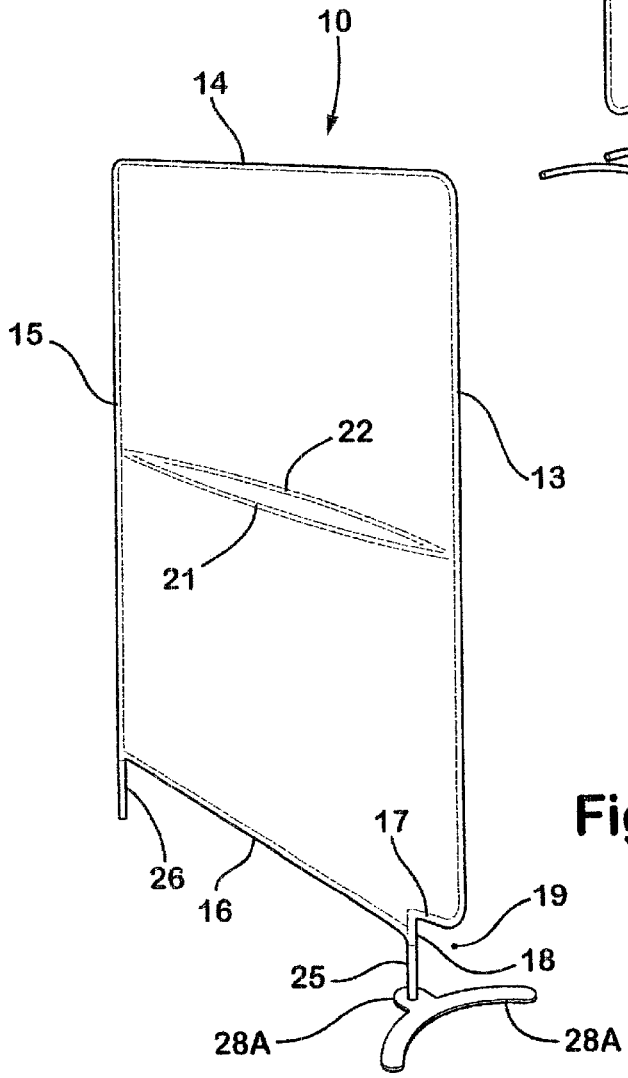
FIG. 7 is perspective view of a screen similar to the screen in FIG. 1 but having a modified foot shaped to complement a floor-mounted utility module.
Figure 7A:
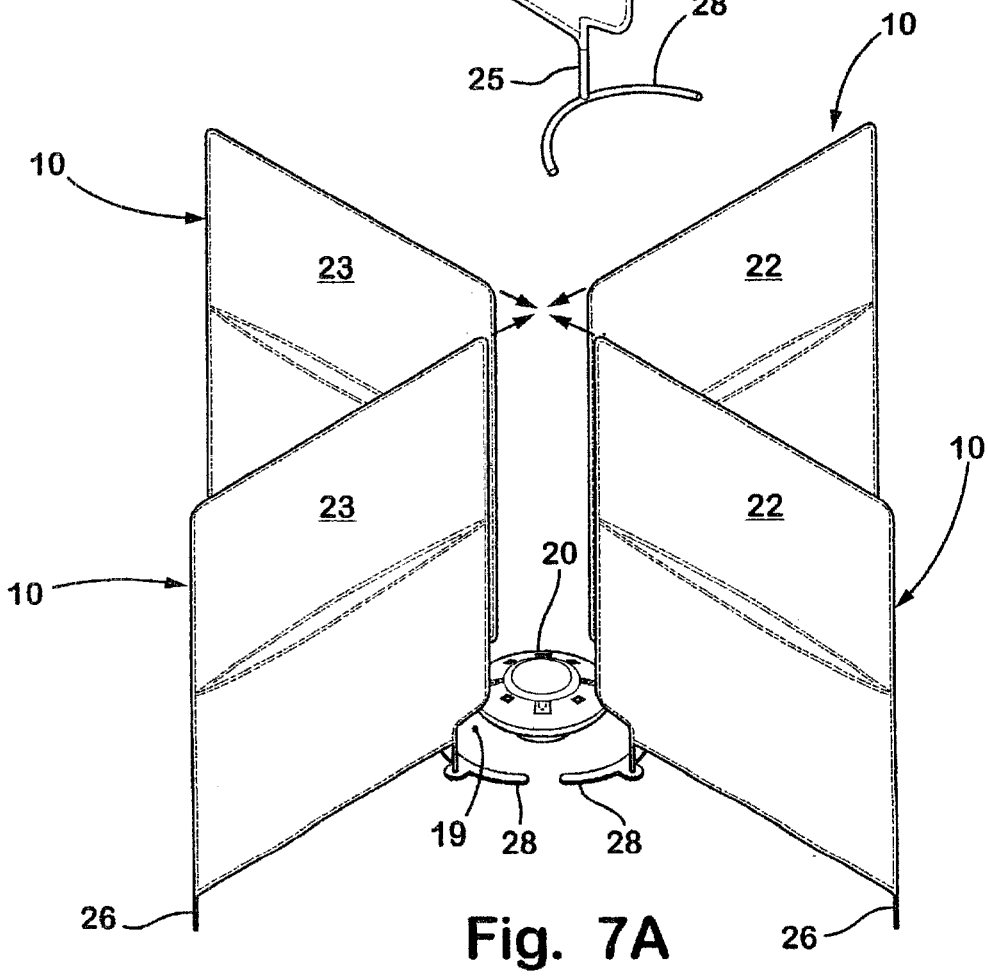
FIG. 7A is a perspective view of four screens of FIG. 7, the screens being positioned around a floor-mounted utility module.

FIG. 7 discloses a screen 10 having a modified foot 28A. The modified foot 28A has an arcuate semi-circular shape similar to that of foot 28. However, modified foot 28A has a flattened cross section and is stamped from sheet metal, while the foot 28 has a round cross section and is made from rod. The modified foot 28A further has a horizontally protruding section 28A' that engages the post section 26 of the frame 11. This positions the foot 28A slightly inward into the space under the notch 19. The foot 28A is configured to slip under a raised perimeter of the illustrated utility module 20, which allows closer positioning of the screen 10 to the utility module 20. FIG. 7A illustrates that four screens 10 can be positioned around a utility module 20. Notably, the screens 10 can be positioned as shown, or can be brought together into edge-abutment as shown by the arrows.

Screen 10B (FIG. 8) includes a screen frame 11B having frame members 13–18, but characteristically, the screen 10B does not have intermediate bowed frame members (21–22). Instead, the top and bottom frame members 14 and 16 are curved when viewed from above. This creates a visual effect similar to that described above in regard to screen 10, even if there is only one layer 23 of performance fabric on the screen 10B. Nonetheless, it is noted that screen 10B can have two layers (23 and 24) and that the inner layer will have a shape that does not extend parallel the second layer due to tensioning of the fabric. In screen 10B, the post section 26 has a bolt 30 threaded into a bottom thereof. The bolt 30 is adjustable to provide height adjustment so that the screen can be adjusted to a horizontal position despite a non-uniform floor. A locking nut (not specifically shown) can be threaded onto the bolt 30, if desired, so that, by rotating the locking nut, an adjusted height can be maintained over time.

Figure 12:
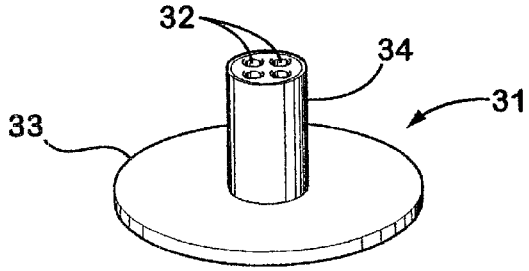
FIG. 12 is an enlarged perspective view of the connector shown in FIG. 8.
Figure 9:
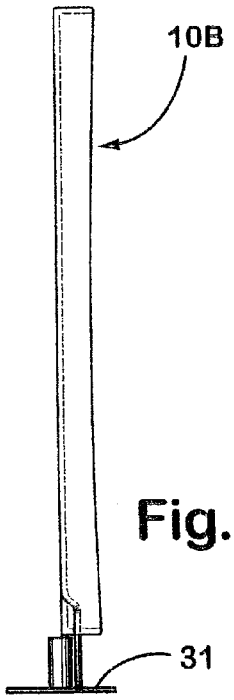
Figure 10:
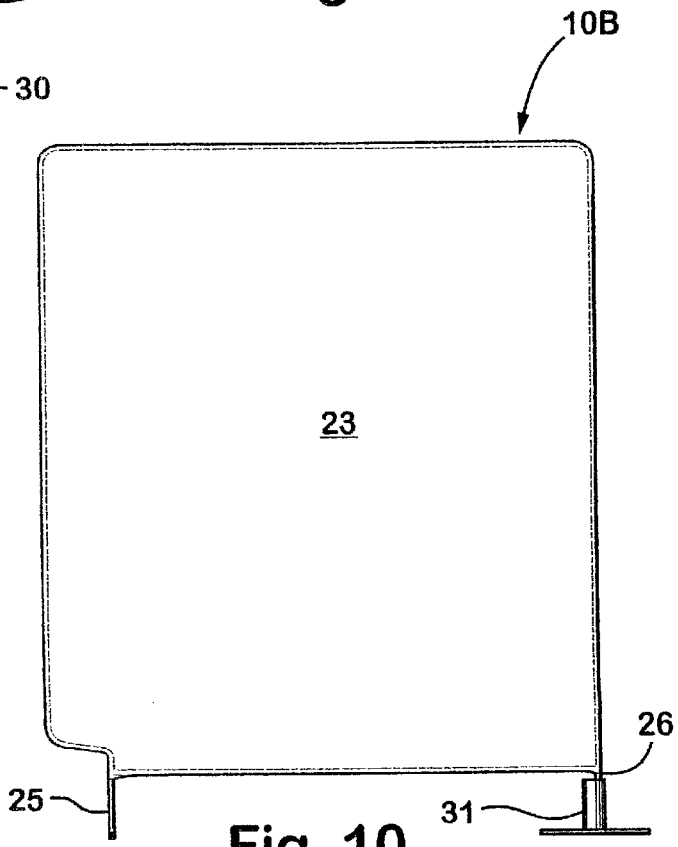

In screen 10B, the post section 25 does not include a horizontally extending foot, but instead a hub 31 is provided with holes 32 shaped to closely receive and engage the post section 25. Specifically, the hub 31 includes a flat disk 33 (FIG. 12) for stably engaging a floor surface, and a cylinder 34 with the holes 32 vertically formed therein. Four holes 32 are shown, although more or less can be provided. The four holes 32 permit the screens 10B to be arranged in a radial pattern with abutting edges similar to that shown in FIG. 7A, or arranged in-line similar to the pattern of FIG. 6.

In the foregoing description, those skilled in the art will readily appreciate that modifications may be made to the invention without departing from the concepts disclosed herein. Such modifications are to be considered as included in the following claims, unless these claims by their language expressly state otherwise.

The present invention claims:

1. A screen apparatus comprising:

a perimeter frame defining opposing bottom corners, one of the bottom corners defining a notch adapted to receive a raised floor device, while a portion of the perimeter frame is positioned over the floor device;

a covering that covers the frame but that leaves the notch open, the covering comprising a sheet of fabric constructed to pass some light so that a person can be recognized through the fabric, the covering including front and rear panels, both of which cover the perimeter frame;

a screen support having a foot that extends laterally from the frame adjacent but inboard of and around the notch; and bowed frame members that extend across the perimeter frame and that engage the front and rear panels, causing the front and rear panels to have a three-dimensional appearance that assists in creating visual privacy when a person is attempting to peer through the screen apparatus.

2. The screen apparatus defined in claim 1, wherein the bowed frame members extend in a horizontal plane at a mid level of the perimeter frame.

3. A screen apparatus comprising:

a perimeter frame defining opposing bottom corners, one of the bottom corners defining a notch adapted to receive a raised floor device, while a portion of the perimeter frame is positioned over the floor device;

a covering that covers the frame but that leaves the notch open; and a screen support having a foot that extends laterally from the frame adjacent but inboard of and around the notch, the foot including forwardly and rearward extending portions that wrap arcuately around the notch and extend toward a vertical side edge of the frame that is located over the notch.

4. The screen apparatus defined in claim 3, wherein perimeter frame defines a second vertical side edge and a longitudinal first plane extending through both of the vertical side edges and further defines a transverse plane that extends perpendicularly to the first plane and through the side edge that is adjacent the notch, and wherein the forwardly and rearwardly extending portions extend to the transverse plane and terminate at the transverse plane.

5. The screen apparatus defined in claim 3, wherein the perimeter frame includes a post support that extends vertically downwardly, the post support including a threaded member that threadably telescopingly engages the post support for providing height adjustment.

6. A screen apparatus comprising:

a perimeter frame having outer frame members forming a perimeter and having at least one bowed intermediate frame member extending between two of the outer frame members; and a screen covering the frame, including at least one flexible panel engaging the bowed intermediate frame member to cause a non-planar condition in the flexible panel.

7. The screen apparatus defined in claim 6, wherein the screen includes front and rear panels spaced apart from each other, each covering a side of the perimeter frame and the area inside the perimeter frame.

8. The screen apparatus defined in claim 6, where the at least one bowed intermediate frame member includes front and rear bowed frame members that lie in a same horizontal plane and that space the front and rear panels apart.

9. The screen apparatus defined in claim 6, wherein the perimeter frame includes a post support that extends vertically downwardly, the post support including a threaded member that threadably telescopingly engages the post support for providing height adjustment.

10. The screen apparatus defined in claim 6, including a screen support having a foot that extends laterally from the screen and around an area under a notch in the perimeter frame.

11. A screen system comprising:

a plurality of screens each having a frame and first and second post supports extending below the frame, the second posts each having laterally extending feet such that each of the screens are individually self-supporting in a free-standing state; and a hub having a bottom section adapted to stably engage a floor surface and having a top section with multiple connectors, the multiple connectors each being shaped to selectively releasably engage the first post supports to secure the plurality of screens in radial positions around the hub, wherein the hub has a laterally extending portion adapted to stably engage a floor surface.

12. The screen system defined in claim 11, wherein the hub includes a section that extends vertically and the connectors comprise vertically extending holes in the hub.

13. The screen apparatus defined in claim 11, wherein each screen includes a covering that comprises a sheet of fabric covering at least one side surface of the screen and that is constructed to pass some light so that a silhouette of a person can be recognized through the fabric.

14. The screen apparatus defined in claim 13, wherein the screen includes a perimeter frame, and wherein the covering includes front and rear panels which cover the perimeter frame.

15. A screen system comprising:

a plurality of screens each having a frame and first and second post supports extending below the frame, the second posts each having laterally extending feet such that each of the screens are individually self-supporting in a free-standing state; and a hub having a bottom section adapted to stably engage a floor surface and having a top section with multiple connectors, the multiple connectors each being shaped to selectively releasably engage the first post supports to secure the plurality of screens in radial positions around the hub, wherein at least one of the first and second post supports have a post section and an adjustable foot that extends vertically from the post section, the foot threadably engaging the post section for providing vertical height adjustment of the screen system.

16. A screen system comprising:

a plurality of identical screens each having a covered frame defining a vertical longitudinal plane and first and second supports extending below the frame for stably engaging a floor surface, one of the first and second supports including a post spaced from a vertical side edge of the covered frame and further including a foot extending laterally from the post, the foot including front and rear portions that extend around a space under the vertical side edge and that extend to a transverse plane that intersects the vertical plane at the vertical side edge, the foot of each screen being configured and adapted to nest against a raised floor device with the vertical side edge being positioned directly over the raised floor device, the foot of each screen further being configured to nest into the foot of an adjacent one of the identical screens in a nested storage position where each successive adjacent screen is positioned adjacent and parallel but longitudinally offset from the adjacent screen.

17. The screen apparatus defined in claim 16, wherein the perimeter frame defines an open notch in a bottom corner and further includes a support with a floor-engaging foot that extends around the notch.

18. The screen apparatus defined in claim 16, wherein at least one of the first and second supports includes a post section and an adjustable foot that extends vertically from the post section, the foot threadably engaging the post section for providing vertical height adjustment of the screen system.

* * * * *